US006438246B1

(12) United States Patent
Kim

(10) Patent No.: US 6,438,246 B1
(45) Date of Patent: Aug. 20, 2002

(54) SPEAKER APPARATUS

(75) Inventor: Jae-Nam Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/160,295

(22) Filed: Sep. 25, 1998

(30) Foreign Application Priority Data

Nov. 3, 1997 (KR) ..... 97-57639

(51) Int. Cl.[7] ..... H04R 25/00
(52) U.S. Cl. ..... 381/337; 381/396; 381/338
(58) Field of Search ..... 381/396–397, 381/412, 337–339, 419–420, 349–350, FOR 140, FOR 143, FOR 159, FOR 161

(56) References Cited

U.S. PATENT DOCUMENTS 4,595,801 A * 6/1986 Coffin ..... 179/115.5
4,757,547 A * 7/1988 Danley ..... 381/165
5,004,066 A * 4/1991 Furukawa ..... 181/156
5,246,353 A * 9/1993 Sohn ..... 417/413
5,357,586 A * 10/1994 Nordschow et al. ..... 381/199
5,388,162 A * 2/1995 Sohn ..... 381/386
5,497,428 A * 3/1996 Rojas ..... 381/199
5,909,015 A * 6/1999 Yamamoto et al. ..... 181/156

* cited by examiner

*Primary Examiner*—Curtis Kuntz
*Assistant Examiner*—P. Dabney
(74) *Attorney, Agent, or Firm*—Staas & Halsey LLP

(57) ABSTRACT

A speaker apparatus, in which sound wave is uniformly radiated to front and rear sides thereof, to prevent distortion of sound due to one way vibration. The speaker apparatus includes a bobbin to vibrate a vibrating plate according to a current applied to a voice coil, and a yoke is disposed at an inner side of the bobbin and spaced apart from the bobbin by a predetermined interval. A sound wave guiding member is disposed at an inner side of the yoke so as to guide the sound wave to the front side and the rear side of the speaker apparatus.

12 Claims, 1 Drawing Sheet

SPEAKER APPARATUS

CROSS-REFERENCE TO RELATED APPLICATIONS

This application claims the benefit of Korean Application No. 97-57639, filed Nov. 3, 1997, in the Korean Patent Office, the disclosure of which is incorporated herein by reference.

BACKGROUND OF THE INVENTION

1. Field of the Invention

The present invention relates to a speaker apparatus, and more particularly, to a speaker apparatus in which a sound wave is uniformly radiated to front and rear sides to thereby prevent distortion of sound due to one way vibration.

2. Description of the Related Art

Generally, a speaker radiates a sound wave through a free space after converting an electronic signal into a sound wave signal.

That is, when a strong magnetic field is generated by a magnet, an electric current flows at a voice coil disposed in the range of the magnetic field to generate a force so that a vibrating plate can vibrate by the force in order to radiate the sound wave.

In general, a conventional speaker as shown in FIG. 1 includes a vibrating plate 11, a bobbin 12 and a voice coil 13 disposed at an inner side of a frame 10, a damper 14 disposed at the frame 10 and a bobbin 12. An upper plate 15, a magnet 16, and a polepiece 17 are disposed at a lower side of the frame 10.

The voice coil 13 is wound at an outer side of the cylindrical-shaped bobbin 12 and moves integrally with the bobbin 12. The bobbin 12 has a front end connected to a lower side of the vibrating plate 11 and an outer side supported by the elastic damper 14. The polepiece 17 is disposed at a predetermined distance from an inner side of the bobbin 12, and the region between the polepiece 17 and the upper plate 15 serves to generate the magnetic field by the magnet 16.

The bobbin 12 vibrates axially according to Fleming's left hand law when the electric current passes through the voice coil 13, and at the same time the vibrating plate 11 disposed at the front end of the bobbin 12 vibrates to radiate the sound.

However, the speaker apparatus as mentioned above involves many problems, such as the sound radiated from the front side of the speaker apparatus is distorted by one way vibration generated by a vibrating plate, the radiating distance of the sound decreases, and the quality of low frequency sound deteriorates. Also, there is a problem that the heat generated by the voice coil causes degradation of adhesives of the voice coil and breakage of the vibrating plate.

SUMMARY OF THE INVENTION

The present invention has been disclosed to solve the aforementioned problem and it is an object of the present invention to provide a speaker apparatus in which a sound wave is uniformly radiated from a vibrating plate to thereby prevent the distortion of sound and to thereby improve the quality of low frequency sound.

It is another object of the present invention to provide a speaker apparatus in which heat generated from the voice coil is effectively radiated to the outside.

Additional objects and advantages of the invention will be set forth in part in the description which follows and, in part, will be obvious from the description, or may be learned by practice of the invention.

In order to achieve the above and other objects of the present invention, a speaker apparatus includes a bobbin to vibrate a vibrating plate according to a current applied to a voice coil, wherein a yoke is disposed at an inner side of the bobbin and spaced apart from the bobbin by a predetermined interval, and a sound wave guiding member is disposed at an inner side of the yoke so as to guide the sound wave to the front side and the rear side of the speaker apparatus.

As described above, according to the speaker apparatus of the present invention, the sound wave radiated from the speaker apparatus is guided by the sound wave guiding member to be radiated to the front and rear sides of the speaker apparatus so as to prevent one way vibration of the sound wave and to even more improve the quality of low frequency sound.

Further, the heat generated from the voice coil is radiated to the path for the sound wave formed in the yoke, to thereby prevent damage of adhesives of the voice coil by the heat or the failure of the vibrating plate in advance caused by the heat.

Further, a supporting member can be formed at the bottom side of the sound wave guiding member because the sound wave guiding member is formed at a bottom side thereof with a supporting portion.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENT

Reference will now made in detail to the present preferred embodiments of the present invention, examples of which are illustrated in the accompanying drawings. The embodiments are described below in order to explain the present invention by referring to the figures.

Figure 1:
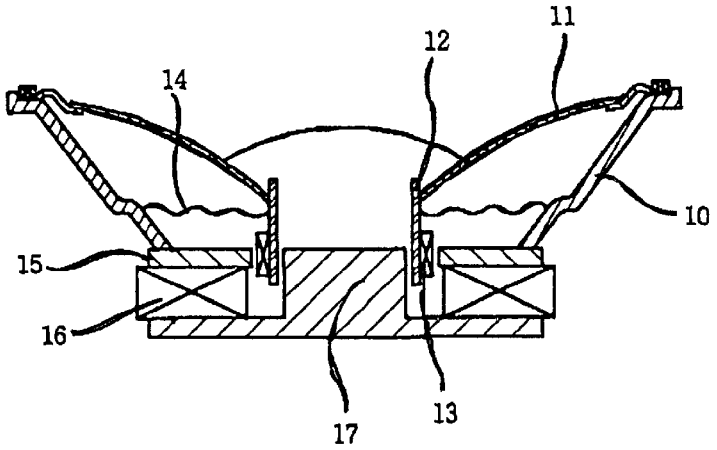
FIG.1 (Prior Art)
FIG. 1 shows a sectional view of a conventional speaker apparatus.
Figure 2:
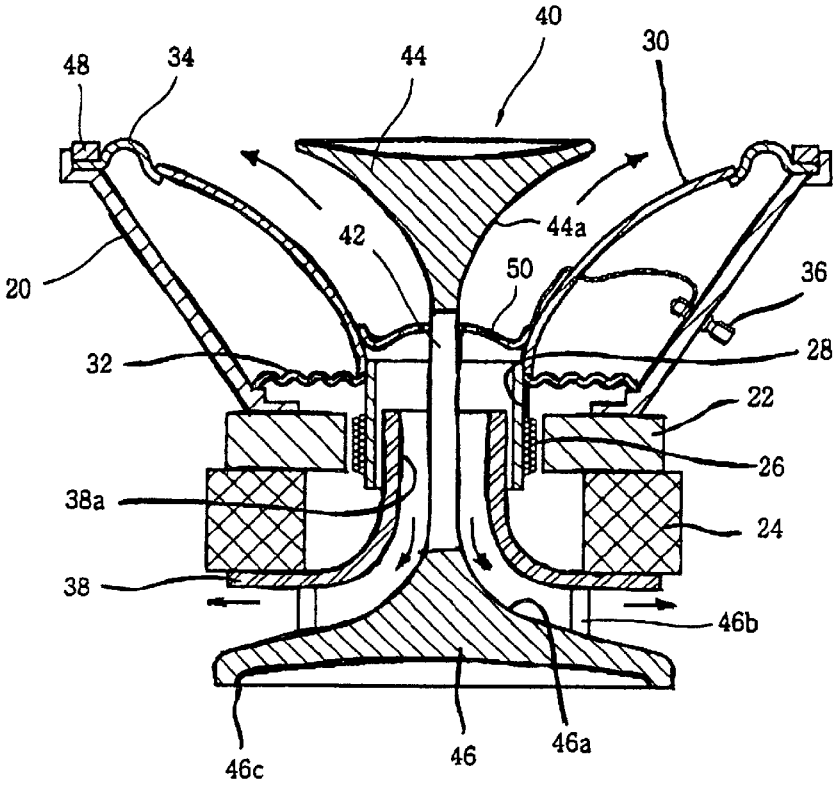
FIG. 2 shows a cross-sectional view of the speaker apparatus according to an embodiment of the present invention.

FIG. 2 shows a cross-sectional view of a speaker apparatus according to an embodiment of the present invention.

An upper plate 22 and a magnet 24 are disposed in order at a lower side of a frame 20. A bobbin 28 is disposed at an inner side of the upper plate 22 at a predetermined distance from the upper plate 22, and a voice coil 26 is wound around the bobbin 28 and between the bobbin 28 and the upper plate 22.

The bobbin 28 has an upper side connected to a lower side of a vibrating plate 30 and is longitudinally supported at an outer side thereof by an elastic damper 32. The elastic damper 32 has one end connected to the bobbin 28 and the other end is secured to the frame 20. The vibrating plate 30 has an upper end which adheres to an upper side of the frame 20 by way of a connection member 34.

An input terminal 36 disposed on the frame 20 is to receive an electric current so that the electric current is applied to the voice coil 26. A yoke 38 is disposed at a lower side of the magnet 24, and a sound wave path 38*a* is arranged at an inner side of the yoke 38. The yoke 38 and the sound wave path 38*a* are arranged at an inner side of the bobbin 28 and the yoke 38 is at a predetermined interval from the bobbin 28.

Meanwhile, a sound wave guiding member 40 is disposed at the inner side of the yoke 38 and in the middle of the sound wave path 38*a*, to guide the sound being radiated to the front and rear direction of the speaker apparatus.

The sound wave guiding member 40 includes an axial portion 42 which is formed at a central portion thereof, a front guiding plate 44 formed at an upper side of the axial portion 42, and a rear guiding plate 46 formed at a lower side of the axial portion 42 and corresponding the front guiding plate 44. The axial portion 42, the front guiding plate 44, and rear guiding plate 46 are connected therebetween to discharge a sound wave by way of rounded portions 44*a* and 46*a*.

The rear guiding plate 46 is protrudingly formed with a plurality of boss portions 46*b* secured to the yoke 38 by securing means, for example, bolts. A supporting portion 46*c* is formed at a lower side of the rear guiding plate 46 to enable the speaker apparatus to be set up easily.

In FIG. 2, the connection member 34 and the frame 20 are sealed together by a gasket 48, and a center cap 50 is adhered to the inner side of the vibrating plate 30.

Next, the operation and effect of the thus constructed speaker apparatus according to the embodiment of the present invention are as follows.

When an electric current signal is supplied through the input terminal 36 to the voice coil 26, the magnet 24 produces a magnetic field. The bobbin 28 moves axially according to the force produced by the magnetic field generated from the magnet 24 according to Fleming's left hand law.

When the vibrating plate 30 which is connected to the bobbin 28 vibrates according to the vibration of the bobbin 28, a sound wave is radiated to the front and rear directions of the speaker apparatus. That is, the sound wave radiated through the vibrating plate 30 is guided by the sound wave guiding member 40, and then radiated to the front side of the speaker apparatus by the front guiding plate 44, and at the same time the sound wave guided through the sound wave path 38*a* at the inner side of the yoke 38 is radiated to the rear side of the speaker apparatus by the rear guiding plate 46.

At this time, the sound wave radiated to the front and rear sides of the speaker apparatus prevents a turbulent flow from being produced by the sound wave guiding member 40 to thereby prevent one way vibration. More particularly, the quality of the low frequency sound is even more improved by the sound wave discharged in the rear direction of the speaker apparatus.

The rounded portions 44*a* and 46*a* formed at the ends of the axial portion 42 of the sound wave guiding member 40 at the connection positions with the front guiding plate 44 and rear guiding plate 46, respectively, function to easily radiate a sound wave. The yoke 38 discharges the heat generated by the voice coil 26 through the sound wave path 38*a* to prevent damage of adhesives and of the vibrating plate 30. Also, the supporting portion 46*c* is formed at the lower side of the rear guiding plate 46 so that the speaker apparatus can be placed and supported on its bottom, to make the speaker apparatus convenient to use.

As described above, according to the speaker apparatus of the present invention, a sound wave radiated from the speaker apparatus is guided by the sound wave guiding member to be radiated to the front and rear sides of the speaker apparatus so as to prevent one way vibration of the sound wave and to enhance the quality of low frequency sound.

Furthermore, the heat generated from the voice coil is radiated along the path of the sound wave formed in the sound wave path 38*a* by the yoke 38, to prevent damage of adhesives of the voice coil or failure of the vibrating plate caused by the heat.

Further, a supporting member can be formed at the lower side of the sound wave guiding member as a supporting portion is formed at the bottom side of the sound wave guiding member.

While the invention has been particularly shown and described with reference to a preferred embodiment, it will be understood by those skilled in the art that various changes in form and detail may be made therein without departing from the spirit and scope of the invention.

What is claimed is:

1. A speaker apparatus, which receives a current signal to generate a sound wave, comprising:

a voice coil to receive the current signal;

a bobbin connected to said voice coil, to vibrate in accordance with the current signal;

a vibrating plate connected to said bobbin, to vibrate in conjunction with the vibration of said bobbin, to generate the sound wave;

a yoke disposed at an inner side of said bobbin and spaced apart from said bobbin by an interval; and a sound wave guiding member disposed at an inner side of and apart from said yoke, to guide the sound wave to the front and rear sides of the speaker apparatus, wherein said sound wave guiding member comprises:

an axial portion having first and second ends opposite to each other;

a front guiding plate formed at a first connection region with the first end toward a front portion of the speaker apparatus; and a rear guiding plate formed at a second connection region with the second end toward a rear portion of the speaker apparatus.

2. The speaker apparatus as claimed in claim 1, wherein said rear guiding plate comprises a supporting portion formed at a bottom portion thereof, said supporting portion to enable the speaker apparatus to be supported.

3. The speaker apparatus of claim 1, wherein the rear guiding plate and said yoke define an opening through which the sound wave is guided from the speaker apparatus.

4. A speaker apparatus, which receives a current signal to generate a sound wave, comprising:

a voice coil to receive the current signal;

a bobbin connected to said voice coil, to vibrate in accordance with the current signal;

a vibrating plate connected to said bobbin, to vibrate in conjunction with the vibration of said bobbin, to generate the sound wave;

a yoke disposed at an inner side of said bobbin and spaced apart from said bobbin by an interval; and a sound wave guiding member disposed at an inner side of said yoke, to guide the sound wave to the front and rear sides of the speaker apparatus, wherein said sound wave guiding member comprises:

an axial portion having first and second ends opposite to each other, a front guiding plate formed at a first connection region with the first end toward a front portion of the speaker apparatus, and a rear guiding plate formed at a second connection region with the second end toward a rear portion of the speaker apparatus; and each of the first and second connection regions comprises a rounded portion.

5. The speaker apparatus of claim 4, wherein the rounded portion of the second connection region guides the sound wave in a direction non-parallel with the axial portion.

6. A speaker apparatus, which includes a voice coil, a bobbin connected to the voice coil, and a vibration plate connected to the bobbin that generates a sound wave, comprising:

a device that receives the sound wave from the vibration plate and heat from the voice coil, wherein said device uniformly radiates the sound wave through a front portion and a rear portion of the speaker apparatus, and removes heat from the voice coil out of the speaker apparatus, said device comprises:

a yoke disposed at an inner side of the bobbin and spaced apart from the bobbin by an interval, and a sound wave guiding member disposed at an inner side of the yoke, to guide the sound wave to the front and rear portion of the speaker apparatus, and the sound wave guiding member comprises:

an axial portion having first and second ends opposite to each other, a front guiding plate formed at a first connection region with the first end toward a front portion of the speaker apparatus, and a rear guiding plate formed at a second connection region with the second end toward a rear portion of the speaker apparatus.

7. The speaker apparatus as claimed in claim 6, wherein the rear guiding plate comprises a supporting portion formed at a bottom portion thereof, the supporting portion to enable the speaker apparatus to be supported.

8. The speaker apparatus as claimed in claim 6, wherein each of the first and second connection regions comprises a rounded portion.

9. The speaker apparatus of claim 6, wherein the sound wave is discharged from the speaker apparatus between openings defined between the front and rear guiding plates and the yoke at the front and rear portions of the speaker apparatus.

10. The speaker apparatus of claim 9, wherein the opening between the rear guiding plate and the yoke is not parallel to a central axis of the yoke.

11. The speaker apparatus of claim 6, wherein the sound wave is turned by the sound wave guiding member to be discharged in a direction non-parallel with an axis of symmetry of the yoke.

12. A speaker apparatus, which receives a current signal to generate a sound wave, comprising:

a voice coil to receive the current signal;

a bobbin connected to said voice coil, to vibrate in accordance with the current signal;

a vibrating plate connected to said bobbin, to vibrate in conjunction with the vibration of said bobbin, to generate the sound wave;

a yoke disposed at an inner side of said bobbin and spaced apart from said bobbin by an interval; and a sound wave guiding member disposed at an inner side of and apart from said yoke, to guide the sound wave to the front and rear sides of the speaker apparatus, wherein:

said yoke includes a central axis through which said sound wave guiding member passes, and the sound wave guiding member guides the sound wave away from the central axis in a direction not parallel to the central axis.

* * * * *